US012669317B1

(12) United States Patent
Tseng

(10) Patent No.: US 12,669,317 B1
(45) Date of Patent: Jun. 30, 2026

(54) COUNTERWEIGHT PROJECTILE

(71) Applicant: WORLITE INDUSTRY CO., LTD., New Taipei City (TW)

(72) Inventor: Jui-Fu Tseng, New Taipei City (TW)

(73) Assignee: WORLITE INDUSTRY CO., LTD., New Taipei City (TW)

( * ) Notice: Subject to any disclaimer, the term of this patent is extended or adjusted under 35 U.S.C. 154(b) by 0 days.

(21) Appl. No.: 19/188,011

(22) Filed: Apr. 24, 2025

(51) Int. Cl.
*F42B 12/36* (2006.01)
*F42B 12/40* (2006.01)
*F42B 12/46* (2006.01)
*F42B 12/50* (2006.01)

(52) U.S. Cl.
CPC ..... *F42B 12/46* (2013.01); *F42B 12/36* (2013.01); *F42B 12/40* (2013.01); *F42B 12/50* (2013.01)

(58) Field of Classification Search
CPC ..... F42B 10/00; F42B 10/02; F42B 12/02; F42B 12/24; F42B 12/36; F42B 12/46; F42B 12/50; F42B 12/40; F42B 12/56; F41B 7/02; F41B 11/81; F41B 11/89
USPC ..... 102/370, 502, 512, 513, 501; 473/569, 473/577; 446/475
See application file for complete search history.

(56) References Cited

U.S. PATENT DOCUMENTS 2,442,381 A * 6/1948 Short ..... F42B 12/56 89/1.51
5,353,712 A * 10/1994 Olson ..... F42B 12/40 102/513
6,145,441 A * 11/2000 Woodall ..... F42B 8/14 102/370
6,393,992 B1 * 5/2002 Vasel ..... H02M 7/48 102/370
6,575,855 B1 * 6/2003 Buzak ..... A63B 43/06 273/DIG. 8
6,723,013 B2 * 4/2004 Ilcisin ..... A63H 33/26 473/570
8,061,276 B2 * 11/2011 Danon ..... F42B 12/74 473/569
9,587,920 B1 * 3/2017 Yoon ..... F42B 27/00
11,733,012 B1 * 8/2023 Nelson ..... F42B 12/46 102/370
2008/0134927 A1 * 6/2008 Skellern ..... F42B 12/367 102/369
2024/0230292 A1 * 7/2024 Pedicini ..... F42B 12/40

* cited by examiner

*Primary Examiner* — James S Bergin
(74) *Attorney, Agent, or Firm* — Che-Yang Chen

(57) ABSTRACT

The present invention provides a counterweight projectile having an upper hemispherical shell and a lower hemispherical shell and each having a plurality of grooves on the inner surface thereof, wherein a hollow space is formed in the combined upper and lower hemispherical shells used to contain a spherical content. The counterweight projectile includes a spherical spring accommodated in the hollow space. The spherical spring is in a shape of a plurality of coils wound along the inner surfaces of the upper and lower hemispherical shells, and is completely supported and held on the inner surfaces of the hemispherical shells. After ejecting, the counterweight projectile which has a matching weight to shoot forward, stably, straight and evenly to an impact point, after contacting the impact point, the spherical spring is squeezed and restored to explode the upper and lower hemispherical shells, and increases the explosion and spread of the spherical content.

2 Claims, 6 Drawing Sheets

COUNTERWEIGHT PROJECTILE

BACKGROUND OF THE PRESENT INVENTION

Field of Invention

The present invention relates to a riot-control projectile, in particular to a counterweight projectile for riot-control purposes.

Description of Related Arts

The conventional riot-control projectiles are initially small steel ball bullets and then turned into rubber ball bullets. There are also projectiles with two hemispherical shells that form a sphere containing chili powder, talcum powder or lacquer liquid. Or, as shown in FIG. 1, two hemispherical shells to form a sphere, wherein an upper hemispherical shell and a lower hemispherical shell with a downward-facing sleeve and an upward-facing sleeve clip a steel ball or rubber ball to form a projectile, which only improves the flight effect of paintballs or powder bullets with the center of mass, but it is easy to accidentally injure a person after the projectile is impacted to produce a bad effect. In order to provide an article that is more in line with practical needs, the inventor has carried out research and development to solve various problems that tend to occur after the impact of the projectile in conventional use.

SUMMARY OF THE PRESENT INVENTION

The main purpose of the present invention is to provide a counterweight projectile that can increase the explosion and spread of the spherical content, achieve more accurate flight of the projectile, and enhance the impact mark effect and riot control function.

In order to achieve the above purpose, the structure of the present invention is as follows a counterweight projectile having an upper hemispherical shell and a lower hemispherical shell which are two halves of a sphere, and each having a plurality of grooves on the inner surface thereof, wherein a hollow space is formed in the combined upper and lower hemispherical shells used to contain a spherical content, such as chili powder, talcum powder or lacquer liquid, wherein the counterweight projectile includes a spherical spring accommodated in the hollow space of the upper and lower hemispherical shells, wherein the spherical spring is in a shape of a plurality of coils wound along the inner surfaces of the upper and lower hemispherical shells, and is completely supported and held on the inner surfaces of the upper and lower hemispherical shells, wherein after ejecting, the counterweight projectile which has a matching weight to shoot forward, stably, straight and evenly to an impact point, after contacting the impact point, the spherical spring is squeezed and restored to explode the upper and lower hemispherical shells, and increases the explosion and spread of the spherical content, such as chili powder, talcum powder, or lacquer liquid, thereby achieving more accurate flight of the projectile and improving the impact mark effect and riot control function.

In order to provide esteemed examiners with a better understanding of the techniques, means, and effects adopted in the present invention to achieve the intended objectives, a preferred embodiment is hereby presented, along with detailed explanations accompanied by views. It is believed that through this, a thorough and concrete understanding of the purpose, features, and advantages of the present invention can be obtained.

DETAILED DESCRIPTION OF THE PREFERRED EMBODIMENT

Figure 1:
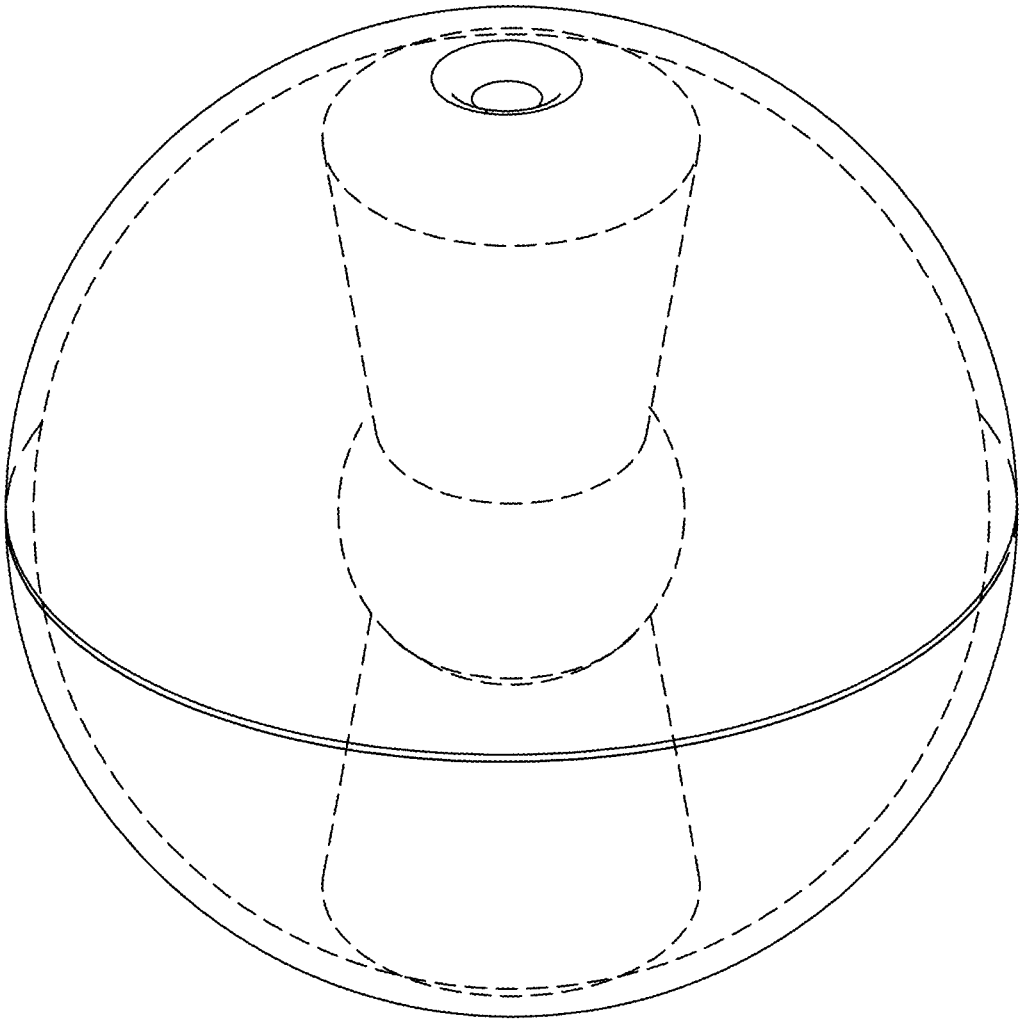
FIG. 1 (Prior Art)
FIG. 1 is a perspective view of the prior art.
Figure 2:
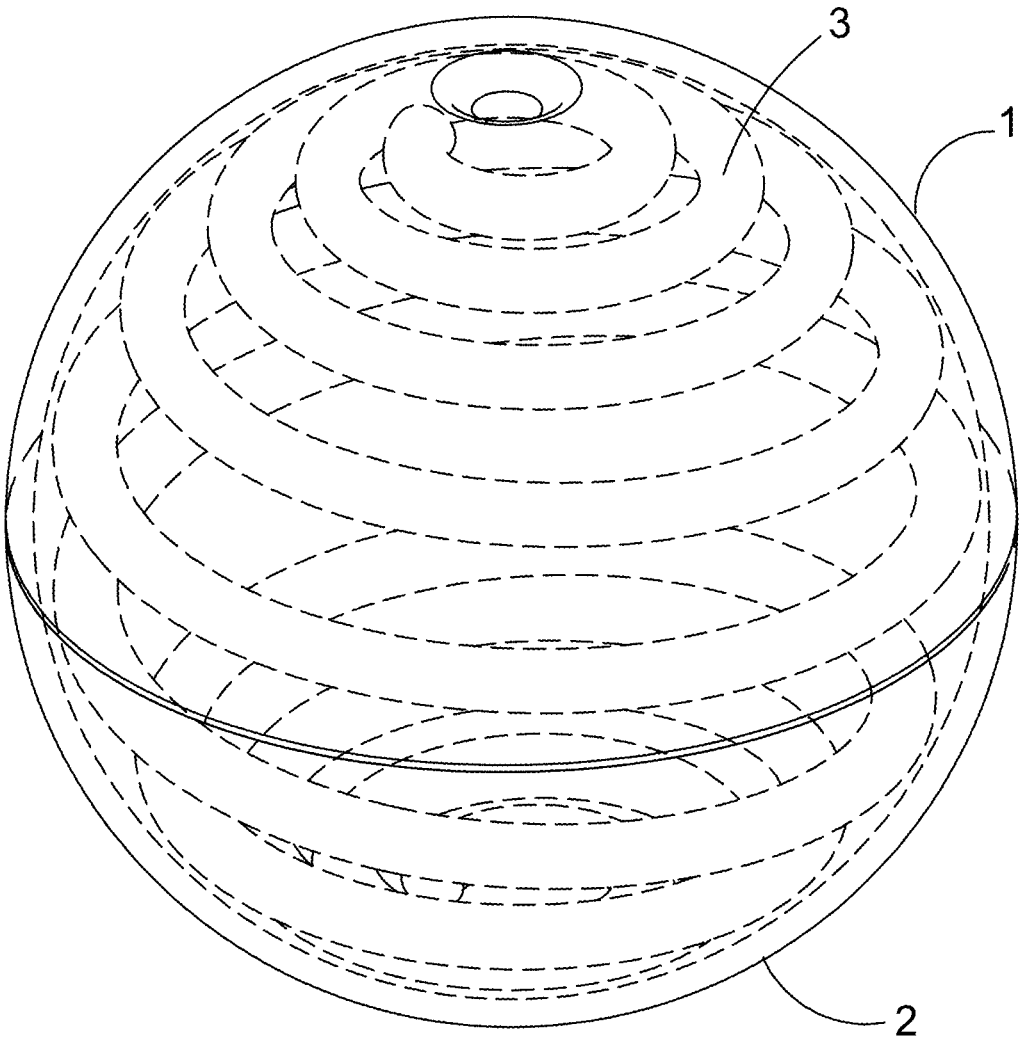
FIG. 2 is a perspective view of an embodiment of the present invention.
Figure 3:
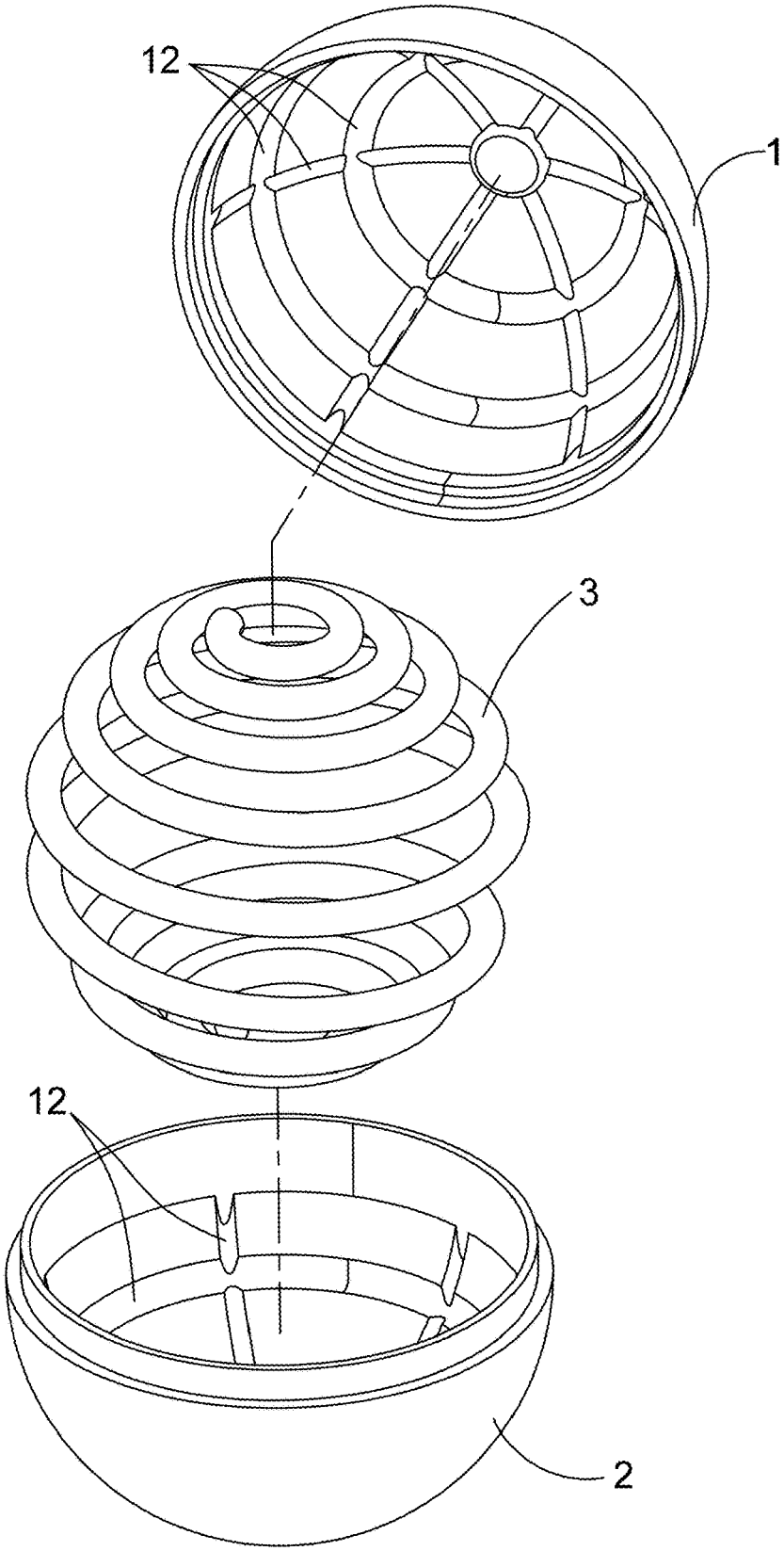
FIG. 3 is an exploded view of the embodiment of the present invention.
Figure 4:
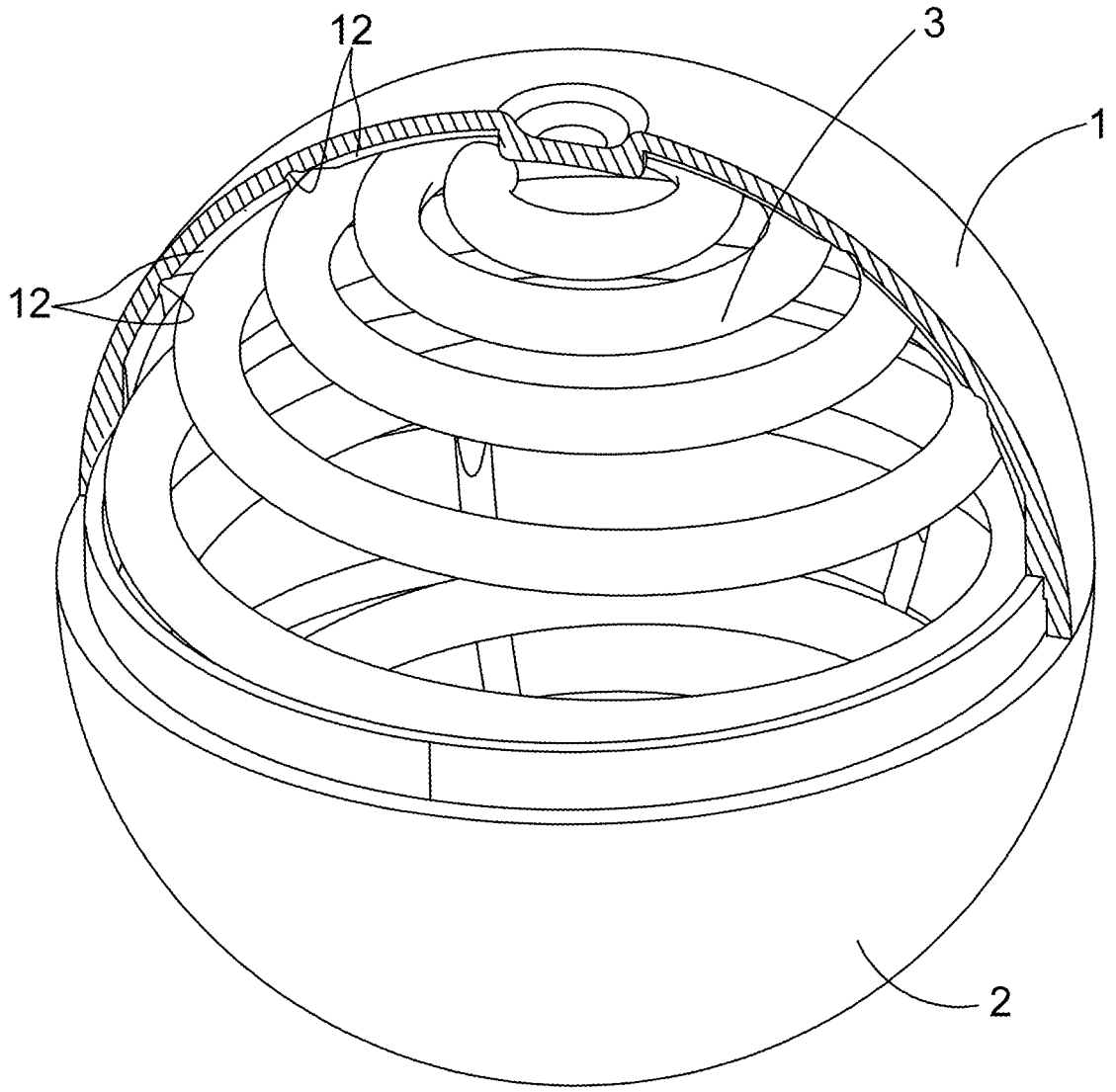
FIG. 4 is a quarter-spherical sectional perspective view of the embodiment of the present invention.
Figure 5:
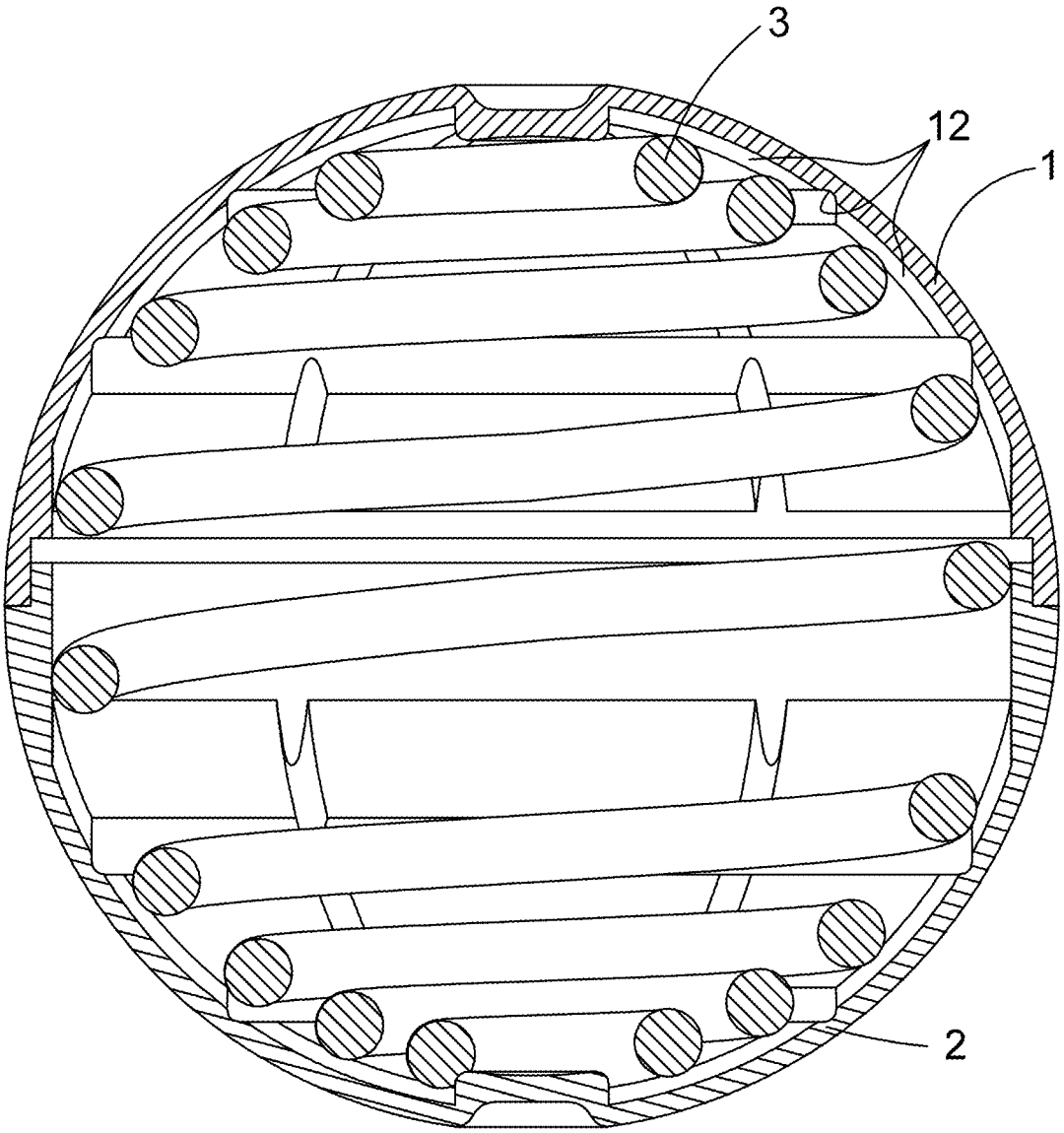
FIG. 5 is a sectional view of the embodiment of the present invention.
Figure 6:
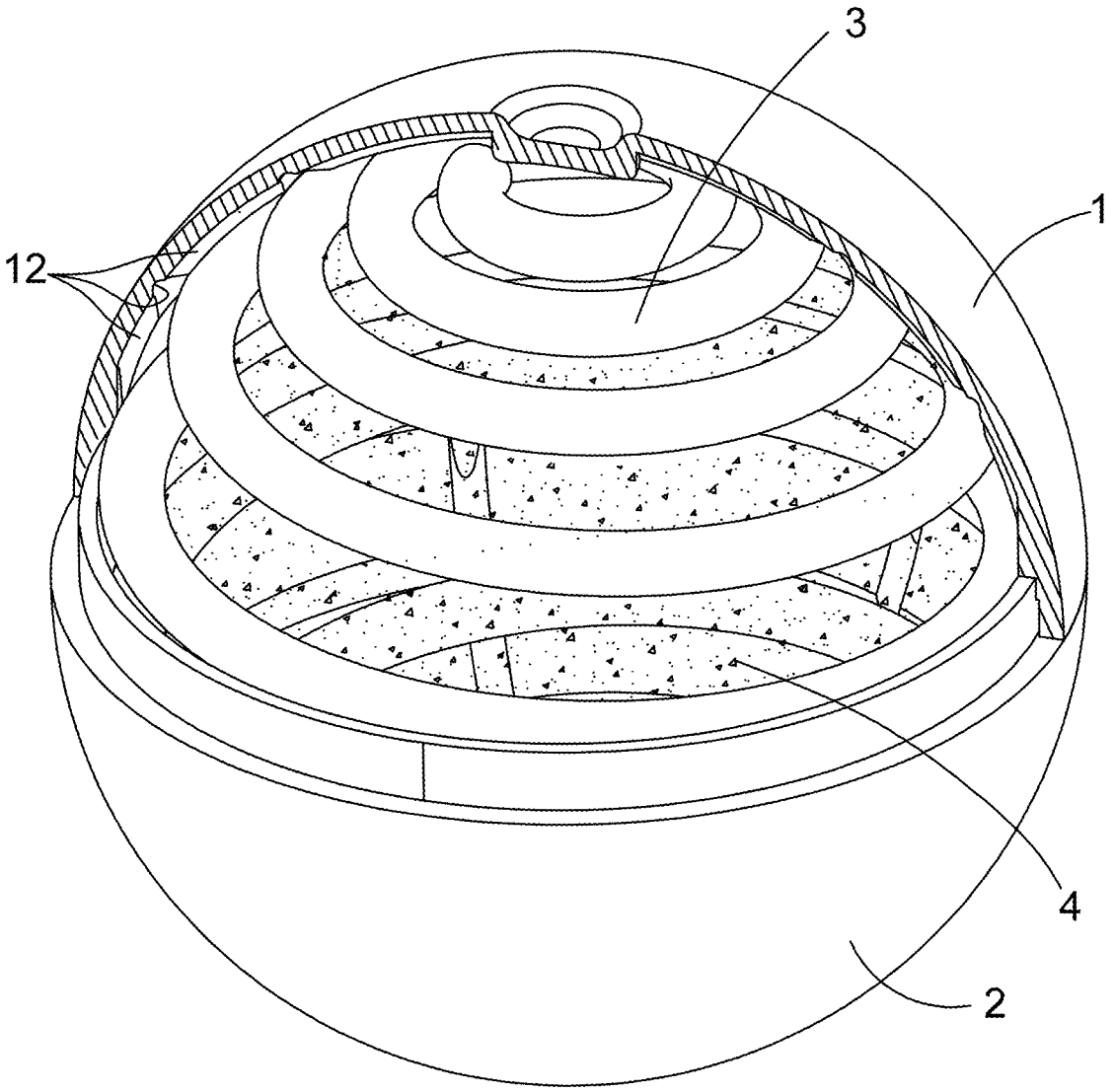
FIG. 6 is a quarter-spherical sectional perspective view of the embodiment of the present invention.

As shown in FIGS. 2 to 6, a counterweight projectile of the present invention has an upper hemispherical shell 1 and a lower hemispherical shell 2 which are two halves of a sphere and each of which has a plurality of grooves 12 on the inner surface thereof, (the hemispherical shells are generally made of colloid which is easy to break, and one of the hemispherical shells is allowed to be transparent, and the other hemispherical shell is opaque and coloured, which is not a limitation of the present invention), wherein a hollow space is formed in the combined upper and lower hemispherical shells 1, 2 used to contain a spherical content 4 (such as chili powder, talcum powder or lacquer liquid), wherein the counterweight projectile includes a spherical spring 3 accommodated in the hollow space of the upper and lower hemispherical shells 1, 2, wherein the spherical spring 3 is in a shape of a plurality of coils wound along the inner surfaces of the upper and lower hemispherical shells, and is completely supported and held on the inner surfaces of the upper and lower hemispherical shells, wherein after ejecting, the counterweight projectile which has a matching weight to shoot forward, stably, straight and evenly to an impact point, after contacting the impact point, the spherical spring is squeezed and restored to explode the upper and lower hemispherical shells, and increases the explosion and spread of the spherical content 4, such as chili powder, talcum powder or lacquer liquid, thereby achieving more accurate flight of the projectile and improving the impact mark effect and riot control function.

In summary, the present invention uses a specially designed spherical spring to achieve a flying counterweight projectile with overall weight that can fly to the impact point along a straight and stable trajectory. After impact, as the counterweight projectile contacts the impact point, the elastic force of the spherical spring promotes the explosion of the upper and lower hemispherical shells of the counterweight projectile and the rapid explosion of the contents to produce an explosion and diffusion effect, thereby completing the projectile flight more accurately and enhancing the impact marking effect and riot control function. The present invention is the easiest for people to understand and implement, so the present invention can provide good usability and convenience, and is a completely different mechanism from the conventional ones.

The above are detailed descriptions and drawings of preferred embodiments of the present invention and are not intended to limit the present invention. The entire scope of the present invention shall be subject to the following claims, and the spirit of the patent scope and similar modified embodiments thereof and similar structures should be included in the present invention.

What is claimed is:

1. A counterweight projectile having an upper hemispherical shell and a lower hemispherical shell combined to form a sphere, each of the upper and lower hemispherical shells having a plurality of grooves on an inner surface thereof, wherein a hollow space is formed between the upper and lower hemispherical shells to contain a content, wherein the counterweight projectile comprises a spherical spring accommodated in the hollow space of the upper and lower hemispherical shells, wherein the spherical spring is in a shape of a plurality of coils wound along the inner surfaces of the upper and lower hemispherical shells, and is completely supported and held on the inner surfaces of the upper and lower hemispherical shells, wherein after being launched, the counterweight projectile is configured to shoot forward, stably, straight and evenly to an impact point, and after contacting the impact point, the spherical spring is squeezed and configured to be restored to explode the upper and lower hemispherical shells thereby spreading the content.

2. The counterweight projectile, as recited in claim 1, wherein the content is selected from the group consisting of chili powder, talcum powder, and lacquer liquid.

* * * * *